US006242679B1

(12) United States Patent
Carlson

(10) Patent No.: US 6,242,679 B1
(45) Date of Patent: Jun. 5, 2001

(54) MULTIMEMBRANE PERCUSSIVE INSTRUMENT AND A METHOD FOR MOUNTING MULTIPLE DRUM HEADS

(76) Inventor: David L. Carlson, 181 Sixth St., Harrison, NJ (US) 07029

( * ) Notice: Subject to any disclaimer, the term of this patent is extended or adjusted under 35 U.S.C. 154(b) by 0 days.

(21) Appl. No.: 08/939,453

(22) Filed: Sep. 29, 1997

(51) Int. Cl.[7] ..... G10D 13/02
(52) U.S. Cl. ..... 84/411 R; 84/414; 84/415
(58) Field of Search ..... 84/411 R, 414, 84/415, 417, 104

(56) References Cited

U.S. PATENT DOCUMENTS 4,300,437 * 11/1981 Hinger et al. ..... 84/411 R
4,337,684 * 7/1982 Le Mert ..... 84/421
4,993,304 * 2/1991 Lovelet ..... 84/411 R

* cited by examiner

*Primary Examiner*—William M. Shoop, Jr.
*Assistant Examiner*—Marlon T. Fletcher
(74) *Attorney, Agent, or Firm*—Galgano & Burke

(57) ABSTRACT

A percussive instrument comprises two shells, each having open ends. The shells are positioned substantially end to end. Drum heads are positioned at the opposing open ends and between the two shells.

9 Claims, 1 Drawing Sheet

Figure 1:
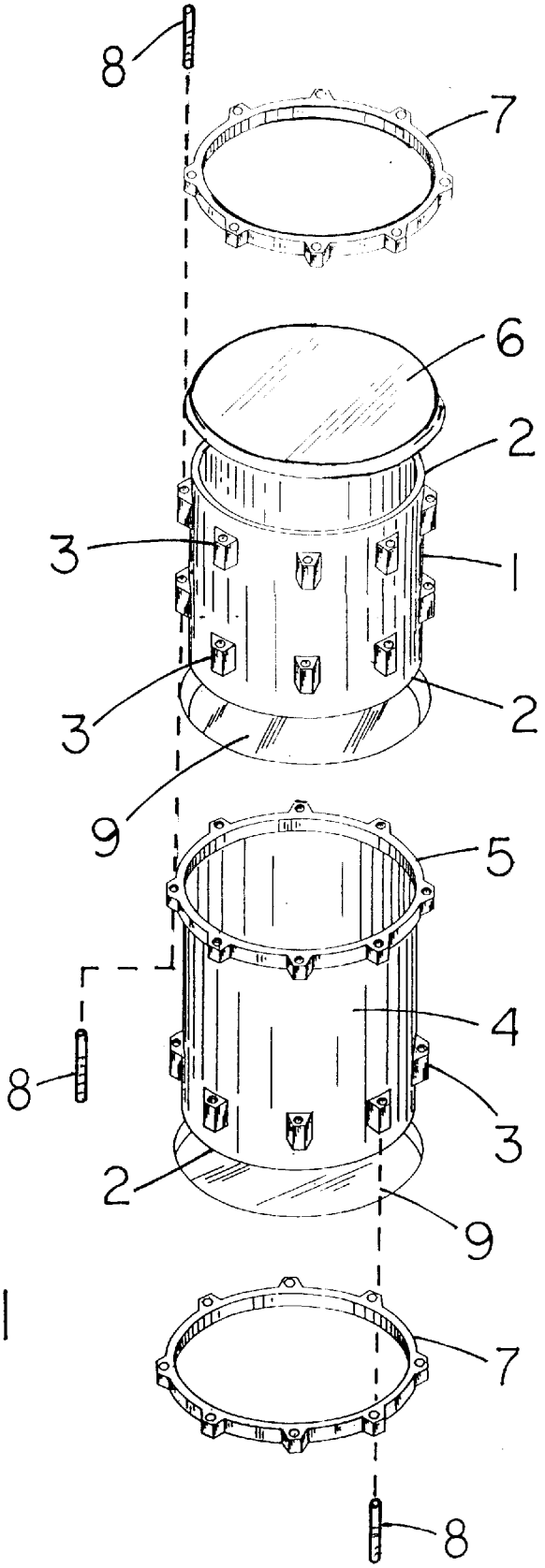

MULTIMEMBRANE PERCUSSIVE INSTRUMENT AND A METHOD FOR MOUNTING MULTIPLE DRUM HEADS

A musical instrument in the nature of a drum that is defined by a plurality of drum heads and drum shells is disclosed. The musical drum is composed of a plurality of drum shells with terminating and intervening drum heads coupled via counter hoops integrated into the drum shell(s).

BACKGROUND OF THE INVENTION

1. Field of the Invention

The field of the invention is related generally to a percussive instrument in the nature of a drum. In particular, this invention is related to a method for coupling multiple drum shells with intervening drum heads via integrated counter hoops.

2. Description of the Prior Art

Conventional percussive instruments in the nature of a drum utilize a single cylindrical shell. One or both ends of the cylinder are terminated with a membrane commonly referred to as a drum head. An internal volume of air is defined by this shell and drum head combination. A variety of mechanical methods for mounting and/or tuning the drum heads is known in the art. A typical application involves one tuned or tensioned head acting as a point of impact and a second tuned or tensioned head acting as a passive resonator.

A compound drum was disclosed in U.S. Pat. No. 4,214,504. This device incorporated a plurality of resonating chambers encompassed by a single shell. A single drum head terminated the plurality of chambers and the concomitant single shell creating a single surface with discrete striking regions.

Shell geometries differing from cylindrical are known in the art. For example, U.S. Pat. No. 5,301,591 disclosed a snare drum incorporating a conical or tapered drum shell.

SUMMARY OF THE INVENTION

In accordance with the present invention, a multimembrane percussive instrument utilizing one or more striking membranes and one or more resonant membranes (hereupon referred to as batter head(s) and resonant head(s) respectively) and methods for mounting the heads is described. The percussive instrument includes at least two or more shell or acoustic chambers and three or more heads. A variety of geometries or configurations that cause the resonant head(s) to oscillate or resonate when the batter head(s) is struck are possible. Rational design geometry will allow this invention to function in a fashion consistent with conventional drums (i.e., snare drum, tom-tom, base drum, etc.) or in a new and novel manner. The geometry and configuration will allow desirable timbrel characteristics to be designed into the instrument.

The shell(s) or acoustic chamber(s) may be fabricated from any material and in any shape that results in desired timbrel characteristics. The heads may be mounted in a fixed fashion or in a manner that facilitates tuning.

The heads may be fabricated from any material and in any shape that results in desired timbrel characteristics. Snare mechanisms may be incorporated into the overall design to allow snares to contact one or more heads in a number of different combinations.

In a preferred arrangement of the percussive instrument of this invention one or more resonant heads are placed between the batter head and a terminal resonant head. The method for mounting intervening resonant head(s) employs a counter hoop integrally incorporated into a shell or acoustic chamber. The angles between the various heads, the shape of the various heads and the size and surface area of the various heads are defined by the design geometry.

For a better understanding of the present invention together with other and further objects, reference is made to the following description, taken in conjunction with the accompanying drawing, and its scope will be pointed out in the claims.

The FIGURE is an exploded view of one embodiment of the present invention.

DETAILED DESCRIPTION

One embodiment of the percussive instrument according to the invention is shown in FIG. 1. A top cylindrical drum shell 1 with bearing edges 2 has lug casings 3 at both ends. A bottom cylindrical drum shell 4 that has a diameter greater than the top drum shell has one bearing edge 2, an integral counter hoop 5 and lug casings 3 at one end. A batter head 6 is mounted on the top of the top shell via a counter hoop 7 and tension rods 8. A resonant head 9 is mounted on the bottom of the bottom shell via a counter hoop 7 and tension rods 8. A resonant head 9 is mounted between the top and bottom drum shells using the integral counter hoop 5 of the bottom drum shell and tension rods 8. This configuration permits independent tuning of the batter and resonant heads.

One embodiment of the present invention comprises a percussive instrument comprising a first drum head, a first shell comprising a first open end and a second open end, a second drum head, a second shell comprising a first open end and a second open end and a third drum head wherein said first drum head is releasably secured to said first open end of said first shell; said second open end of said first shell is releasably secured to said first open end of said second shell with said second drum head disposed in between said first shell and said second shell; and said third drum head connected to said second open end of said second shell. According to other preferred embodiments, an integrated counter hoop is used to couple a drum head to at least one shell, more than two shells or three drum heads are employed, snare mechanisms are connected to the drum heads, the drum heads are different sizes, a plurality of drum heads are disposed between adjacent shells, and/or comprise means for independently tuning the drum heads.

What is claimed:

1. A percussive instrument comprising a first drum head, a first shell comprising a first open end and a second open end, a second drum head, a second shell comprising a first open end and a second open end and a third drum head wherein said first drum head is releasably secured to said first open end of said first shell;

said second open end of said first shell is releasably secured to said first open end of said second shell with said second drum head disposed in between said first shell and said second drum head; and said third shell connected to said second open end of said second shell.

2. A percussive instrument according to claim 1 wherein at least one drum head is coupled to one of said shells with a counter hoop.

3. A percussive instrument according to claim 2 wherein said counter hoop is integrated with one of said shells.

4. A percussive instrument according to claim 1 comprising more than two shells.

5. A percussive instrument according to claim 1 comprising more than three drum heads.

6. A percussive instrument according to claim 1 further comprising at least one snare mechanism is operatively connected to one of said drum heads.

7. A percussive instrument according to claim 1 comprising a plurality of drum heads between said first shell and said second shell.

8. A percussive instrument according to claim 1 wherein said first shell has a different diameter than said second shell.

9. A percussive instrument according to claim 1 further comprising means for independently tuning said drum heads.

* * * * *

UNITED STATES PATENT AND TRADEMARK OFFICE

CERTIFICATE OF CORRECTION

PATENT NO. : 6,242,679 B1
DATED : June 5, 2001
INVENTOR(S) : David L. Carlson

It is certified that error appears in the above-identified patent and that said Letters Patent is hereby corrected as shown below:

Column 3,
Line 2, should read -- shell and said second shell; and --
Lines 3 and 4, should read -- said third drum head connected to said second open end of said second shell. --

Signed and Sealed this

Fourteenth Day of May, 2002

*Attest:*

*Attesting Officer*

JAMES E. ROGAN
*Director of the United States Patent and Trademark Office*